United States Patent [19]

Anderson

[11] Patent Number: 4,873,009

[45] Date of Patent: Oct. 10, 1989

[54] BORATED LUBE OIL ADDITIVE

[75] Inventor: Ronald L. Anderson, Naperville, Ill.

[73] Assignee: Amoco Corporation, Chicago, Ill.

[21] Appl. No.: 212,512

[22] Filed: Jun. 28, 1988

Related U.S. Application Data

[63] Continuation of Ser. No. 90,653, Aug. 28, 1987, abandoned, which is a continuation of Ser. No. 549,237, Nov. 4, 1983, abandoned, which is a continuation-in-part of Ser. No. 362,955, Mar. 29, 1982, abandoned.

[51] Int. Cl.[4] ..... C10M 133/44; C10M 139/00

[52] U.S. Cl. ..... 252/49.6; 252/51.5 A

[58] Field of Search ..... 252/49.6, 51.5 A

[56] References Cited

U.S. PATENT DOCUMENTS 3,254,025 5/1966 Le Suer ..... 252/32.7 E 3,282,955 11/1966 Le Suer ..... 252/251.5 A

FOREIGN PATENT DOCUMENTS 1053485 8/1964 United Kingdom .

1054310 8/1964 United Kingdom .

*Primary Examiner*—Jacqueline V. Howard

*Attorney, Agent, or Firm*—Matthew R. Hooper; William H. Magidson; Ralph C. Medhurst

[57] ABSTRACT

Borated reaction product of a long chain aliphatic succinic acid compound and alkylene diamine having an average of at least about 2.5 N-substituted hydroxyalkyl groups.

7 Claims, No Drawings

BORATED LUBE OIL ADDITIVE

This is a continuation of application Ser. No. 090,653 filed Aug. 28, 1987, which is a continuation of application Ser. No. 549,237 filed Nov. 4, 1983 which in turn is a continuation-in-part of Ser. No. 362,955 filed Mar. 29, 1982,, all now abandoned.

This invention relates to a borated reaction product of a long chain aliphatic succinic acid compound and alkylene diamine having an average of at least about 2.5 N-substituted hydroxyalkyl groups and lube oil additives containing said borated reaction products.

This application is a continuation-in-part of application Ser. No. 362,955 filed Mar 29, 1982.

The patent literature is replete with disclosures of the use of various long chain aliphatic succinic acid compounds in lubricating oil compositions. For example, Lubrizol discloses in U.S. Pat. Nos. 3,219,666 of Norman et al; 3,381,022 of Le Suer; 3,630,904 of Musser et al; 3,836,471 of Miller; 3,533,945 of Vogel; 3,282,955 of Le Suer; etc. that foreign particles in lubricating oils is a particular problem. U.S. Pat. No. 3,282,955 explains the problem at Column 1, lines 19 to 37 as follows: "One of the principal problems associated with present day automobile crankcase lubricants is that posed by the inevitable presence in the lubricant of foreign particles such as dirt, soot, water, and decomposition products resulting from breakdown of the lubricating oil. Even if there were none of this latter contaminant present the very nature of the design of the modern internal combustion engine is such that a significant amount of foreign matter will accumulate in the crankcase. Perhaps the most important of these contaminants is water because it seems to be responsible for the deposition of a mayonaise-like sludge. It appears that if there were no water present the solid components of the mayonnaise-like sludge would circulate with the oil and be removed by the oil filter. It will be readily appreciated that the deposition of the sludge presents a serious problem with respect to the efficient operation of the engine and that it is desirable to prevent such deposition of sludge-like material." Subsequently, U.S. Pat. No. 3,630,904 points out at Column 1, lines 42 et seq. that high molecular weight acylated nitrogen compositions have achieved widespread use as ashless dispersants in crankcases and filters. Generally, these ashless dispersants are prepared by reacting high molecular weight mono- or polycarboxylic acid acylating agents with a suitable amine or hydroxy compound. While the patentee indicates that the commercial success of these acylated nitrogen compositions as ashless dispersants is conclusive evidence of their effectiveness as sludge-dispersants, the patentee points out that sludge can and does form on metal surfaces in areas of the engine where water vapor condenses at places such as rocker arms, oil-fill caps, etc.

As indicated above, numerous patents disclose various long chain aliphatic succinic acid derivatives. In somewhat greater detail, U.S. Pat. Nos. 3,219,666 and 3,640,904 disclose that hydroxyalkyl substituted amines and polyamines can be reacted with long chain aliphatic succinic acid compounds and formulated into lubricating oil compositions. U.S. Pat. No. 3,282,955 discloses the formation of lubricating oil additives based upon borated reaction products of long chain succinic acid compounds and mono-amines, including N-substituted hydroxyalkylated amines. U.S. Pat. No. 3,533,945 discloses lube oil additives based upon borated reaction products of long chain aliphatic succinic acid compounds and polyols. U.S. Pat. No. 3,836,471 discloses lube oil compositions containing the reaction product of long chain aliphatic succinic acid compounds and at least one polyoxyalkylene alcohol demulsifier with the possibility of utilizing amines such as polyalkylene polyamines or hydroxyalkylated polyamines together with the polyoxyalkylene alcohol demulsifier. U.S. Pat. No. 3,630,940 discloses lube oil compositions containing additives formed by reacting adducts of a hydroxyalkylamine and an acylating agent with a long chain aliphatic succinic acid compound. U.S. Pat. No. 4,097,389 of Andress discloses lube oil compositions containing borated oxazoline additives wherein the oxazoline component is a cyclized reaction product of a long chain succinic acid compound and a tris(hydroxymethyl-)aminomethane. U.S. Pat. No. 4,071,548 of Okamoto discloses lube oil compositions comprising borated reaction products of long chain aliphatic succinic acid esters and/or amides containing oxyalkylene chains of at least 5 oxyalkylene units. All of these patents are hereby incorporated by reference. However, none of these references discloses borated reaction products of a long chain succinic acid compound and an alkylene diamine having an average of at least about 2.5 N-hydroxyalkyl groups and lube oil groups containing these borated reaction products.

While additives prepared from the reaction product of long chain aliphatic succinic acid compounds and alkylene polyamines are excellent lube oil additives, they are inferior to additives where the alkylene polyamine is hydroxyalkylated. In general, the more hydroxyalkyl moieties the greater the dispersancy. However, the products based on hydroxyalkylated polyamines have the drawback that they tend to attack engine seals particularly those of the fluorocarbon polymer type thereby limiting the use of lubricating oils containing these dispersants. Accordingly, there is a need for high dispersancy lube oil additives that do not attack engine seals based on fluorocarbon polymers.

The general object of this invention is to provide a lube oil additive having high dispersancy which is compatible with fluorocarbon engine seals. Other objects appear hereinafter.

We have now found that the objects of this invention can be attained with borated reaction products of long chain aliphatic succinic acid compounds and alkylene diamines having on an average at least about 2.5 N-hydroxyalkyl groups. The additive of this invention is a particularly well balanced product. While we have found that it is generally desirable to use long chain succinic acid amides and esters based on polyalkylene polyamines having a relatively high concentration of N-hydroxyalkyl moieties because the more N-hydroxyalkyl substituents the cleaner the engine, we have also found that the more amino groups in the polyamine the greater the degradation of fluorocarbon polymer seals. This means that while it is desirable to have a high level of hydroxyalkyl moieties in the additive to enhance engine cleanliness and reduce sludge formation, alkylene amines containing more than 2 amino groups cannot be utilized in this invention. Hydroxyalkylated monoamines do not provide adequate dispersancy. At the same time, it is imperative that the diamine have at least about 2 N-hydroxyalkyl groups, preferably 2.5 to 4 N-hydroxyalkyl groups, in order to provide acceptable levels of engine cleanliness. Boration is necessary in order to stabilize the additive and reduce engine seal attack. Other things being equal, omission of boration leads to unacceptably high levels of fluorocarbon engine seal attack. However, boration of additives prepared from N-unsubstituted diamines does not reduce fluorocarbon engine seal attack. Accordingly, the lube oil additives of this invention are particularly well balanced.

Briefly the lube oil additives of this invention can be prepared by borating reaction products of an alpha long chain succinic acid compound and an alkylene diamine having on an average at least about 2.5 N-hydroxyalkyl groups. In somewhat greater detail, the dispersants of this invention can be prepared by (1) reacting an unsubstituted alkylene diamine with at least 2.5 mols of hydroxyalkylating reagent per mol of alkylene diamine, (2) reacting the resulting N-hydroxyalkyl alkylene diamine with an alpha long chain aliphatic succinic acid or anhydride and (3) borating the reaction product of step 2.

The alkylene diamines useful in this invention have the structure $NH_2$-R-$NH_2$ wherein R is an alkylene group of from 2 to 24 carbon atoms, such as ethylene, 1,2-propylene, trimethylene, hexamethylene, dodecamethylene, tetracosene, etc. In general, alkylene diamines containing from about 6 to 12 methylene units are preferred, in order to provide a dispersant having the most advantageous properties, particularly compatibility with the lubricating oil. Hexamethylenediamine is preferred because of its relatively low cost and compatibility of additives prepared from it with lube oils.

Suitable hydroxyalkylating reactants include halohydrins and vicinal epoxies (olefin oxides) containing from 2 to 4 carbon atoms in the alkylating agent, such as ethylene oxide, 1,2-propylene oxide, 1,2-butylene oxide, 2-chloro-1 ethanol, 2-chloro-1-propanol, 3-bromo-1propanol, 4-chloro-butanol, etc. The vicinal epoxies are preferred because of their relatively high reactivity with the amine groups in the alkylene diamine. Of the various olefin oxides, propylene oxide is preferred. Hydroxyethylated alkylene diamines tend to yield borated dispersants which are slightly incompatible with lubricating oils in the sense that they yield hazy borated products. Ethylene oxide also has the disadvantage that it has a tendency to hydroxyethylate N-hydroxyethylated groups on the diamine thereby reducing the efficiency of the reaction. In contrast propylene oxide yields borated additives which are fully compatible with the lubricating oils and has a reduced tendency to react with N-hydroxypropylated amines. Butylene oxide tends to be less reactive than either ethylene oxide or propylene oxide and is substantially more expensive. The hydroxyalkylating agents can be used in a concentration of about 2.5 to 6 mols per mol of alkylene diamine. In general approximately 2.5 to 4.5 mols of alkylene oxides per mol of diamine is preferred since the final products have about 2.5 to 4 N-hydroxyalkyl groups which provides the best properties at the lowest cost.

The alkylene diamine can be hydroxylalkylated under conventional conditions, i.e. by reaction at 50° to 300° C. from 1 to 10 hours.

The long chain aliphatic succinic acid compounds useful in this invention can be prepared by any of the techniques described in the aforesaid patents, which have been incorporated by reference. For example, an acid compound, particularly an ethylenically unsaturated dicarboxylic acid compound (acid or anhydride), such as maleic acid, maleic anhydride, fumaric acid, etc., can be reacted with a suitable olefin or halogenated olefin at a temperature of about 100° to 300° C. yielding an alkenyl or alkyl substituted succinic acid or anhydride. If desired the unsaturated groups in the alkenyl group can be removed by standard hydrogenation procedures. Typically, the olefins or halosubstituted olefins contain from about 8 to 500 carbon atoms or more and can include homopolymers and copolymers of mono olefins such as ethylene, propylene, 1-butene, isobutene, etc. However, as indicated above any of the techniques utilized in this art can be employed to produce the long chain succinic acid compound.

The long chain aliphatic succinic acid compounds are then reacted with the N-substituted hydroxyalkyl diamine under conditions normally employed in this art at a temperature of from 0° to 250° C. If desired a solvent such as benzene, toluene, naphtha, lube oil, xylene and n-hexane or the like can be used to facilitate the control of the reaction. From about 0.5 to 2 mols of long chain aliphatic succinic acid compounds can be reacted per mol of N-substituted hydroxyalkyl alkylene diamine. It will be noted that the long chain aliphatic succinic acid compound for purposes of this reaction is difunctional while the N-substituted hydroxy alkylene diamine is tetrafunctional irrespective of the degree of substitution of the alkylene diamine.

The boron compounds useful in this invention include boron oxide, boron dihalides (boron trifluoride, boron tribromide, boron trichloride) boron acids, such as tetraboric acid, metaboric acid and simple esters of the boron acids (trialkyl borates containing 1 to 8 carbon alkyl groups such as methyl, ethyl, n-octyl, 2-ethylhexyl, etc.).

The boron compounds can be reacted with the long chain succinic acid-hydroxy alkylene diamine product at a temperature of from about 50° to 250° C. preferably from about 100° to 170° C. with a sufficient concentration of boron compound to yield a long chain succinic acid product containing at least 0.15 percent by weight boron (excluding lube oil). The boron compound can be reacted in a ratio of from 0.1 to 10 moles of boron compound per equivalent of starting long chain succinic acid compound in step 1. This step can be carried out in the presence of diluent or solvent. In general, the more boron incorporated, the lower the seal attack.

Unless specified in the examples following, percent boron content is always based on lube oil and additive concentration.

EXAMPLE I

Four hundred fifteen moles) was added dropwise to two hundred sixty-two grams of hexamethylenediamine (2.26 moles) at 150° C. in a two liter, 3-necked, round bottom flask fitted with an overhead stirrer, condenser and temperature controller attached to a heating mantle through the top of the condenser over a four hour period while stirring. After the reaction was complete the reaction mass was found to have gained three hundred ninety-five grams (6.81 moles propylene oxide, 95% incorporation) or 3 moles propylene oxide per mole of hexamethylenediamine. The pale yellow N-hydroxypropylated hexamethylenediamine having on an average about 3 hydroxypropyl groups per hexamethylenediamine moiety remained a liquid at room temperature for several days but slowly crystallized to a low melting solid.

One hundred sixty-six grams of the hydroxypropylated hexamethylenediamine (0.571 moles), sixteen hundred grams of a 50% active solution in oil of polybutenyl-succinic anhydride (0.571 moles) having a molecular weight of fourteen hundred, and six hundred forty-nine grams SX-5 base oil were heated at 190° C. for two hours in a 3 liter, round bottom, 3-necked flask under a mold nitrogen purge.

The reaction mass was cooled to 130° C. and treated with 250 ml xylene and 35.3 grams of boric acid (0.571 moles). The mixture was then refluxed at 140° C. with azeotropic removal of water and finally heated to 180° C. with a nitrogen purge to remove the xylene. The product (including base oil) was filtered with celite and contained 0.23% boron (0.25% B theoretical) and 0.63 nitrogen (0.66% nitrogen theoretical).

EXAMPLE II

This Example illustrates the production of a borated reaction product of a long chain aliphatic succinic acid compound and an unsubstituted alkylene diamine. Twelve hundred grams of a 40.5 percent active solution (in oil) of polybutenyl-succinic anhydride (0.217 moles) having a molecular weight of 2240 and 50.4 grams hexamethylenediamine (0.43 moles) was heated at 100° C. for two hours in a 3 liter, 3-necked, round bottom flask. The temperature was then raised to 150° C. and nitrogen was blown through the solution to remove excess hexamethylenediamine. The resultant product was treated with ninety-seven grams of boric acid suspended in a Mannich condensation product of polybutylphenol, tetraethylenepentamine and formaldehyde (2.72% boron) overnight at 95° C. to yield a product containing 0.20% by weight boron and 0.47% nitrogen.

EXAMPLE III

This Example illustrates the production of a borated reaction product of a long chain aliphatic succinic acid compound and alkylene diamine having an average of about 2 N-substituted hydroxypropyl groups. Twenty-four and nine-tenth grams of hydroxypropylated hexamethylenediamine prepared by the method of Example I except that a two to one mole ratio of propylene oxide to diamine (0.107 moles) was used, three hundred grams of a 50% active solution (in oil) of polybutenyl-succinic anhydride (0.107 moles) combined with one hundred twelve grams SX-5 base oil were heated at 190° C. for two hours in the manner described in Example II. Two hundred grams of this reaction product (0.0490 moles) were treated with 15.2 grams boric acid (0.246 moles) and eight grams of water at 82° C. for ninety minutes and then at 170° C. for two hours followed by filtration through celite. The final product was shown to be primarily amide and imide by infrared spectroscopy and contained 1.11% B (1.31 theoretical).

EXAMPLE IV

This Example illustrates the production of an unborated reaction product of polybutenyl-succinic anhydride and hydroxypropylated hexamethylenediamine having approximately three hydroxypropyl groups per hexamethylenediamine moiety. Sixty-two grams of the hexamethylenediamine propylene oxide reaction product of Example I, twelve hundred grams of a 40% active oil solution of polybutenyl-succinic anhydride having a molecular weight of 2240 (0.214 moles) and ninety-three grams SX-5 base oil were heated at 150° C. for five hours with a mild nitrogen purge in a 3 liter, 3-necked flask. The resultant product contained 0.456% nitrogen (0.44 theoretical) and was shown by infrared spectroscopy to be a mixture of ester (1740 $cm^{-1}$) and amide (1650 $cm^{-1}$)

EXAMPLE V

This Example illustrates the preparation of a borated reaction product of polybutenyl-succinic anhydride and hydroxypropylated hexamethylenediamine having approximately three hydroxypropyl groups per hexamethylenediamine moiety and a relatively high boron content. One hundred nineteen grams of the hexamethylenediamine propylene oxide reaction product of Example I, one thousand forty-five grams of a 55% active oil solution of polybutenyl-succinic anhydride having a molecular weight of fourteen hundred (0.41 moles) and five hundred seventy one grams SX-5 base oil were heated at 190° C. for two hours with a nitrogen purge in a 5 liter, 3-necked flask. After the reaction mass was cooled to 82° C., one hundred twenty-seven grams boric acid (2.05 moles) and sixty three grams of water were added. The reaction mixture was slowly heated to 170° C. and held at 170° C. for two hours and filtered. The final product contained 0.99% boron.

EXAMPLE VI

This Example illustrates a comparison of sequence VD engine test of dispersants made according to Examples I, II, IV and V.

Sequence VD Results

| Dispersant | (wt. %) | Oil Type | Avg. Sludge (9.1)* |
|---|---|---|---|
| Example I | (4.15) | SF/CC | 9.65 |
| Example I | (4.00) | SF/CD | 9.45 |
| Example II | (5.00) | SF/CC | 8.99 |
| Example IV | (5.00) | SF/CC | 9.52 |
| Example V | (4.50) | SF/CC | 9.57 |

| Dispersant | Avg. Varnish (6.6)* | Piston Varnish (6.7)* |
|---|---|---|
| Example I | 7.70 | 7.54 |
| Example I | 7.85 | 7.38 |
| Example II | 7.44 | 6.98 |
| Example IV | 7.72 | 7.60 |
| Example V | 6.39 | 6.99 |

*Minimum rating needed to pass (10 = clean)

The above data shows that a borated unpropoxylated adduct failed the sequence VD test whereas the propoxylated and borated propoxylated adducts of Examples I, II and IV passed the above test. The borated propoxylated adduct of Example V passed the average sludge and piston varnish tests and would pass the average varnish test at a higher concentration.

EXAMPLE VII

Dispersants prepared in accordance with the preceding Examples were tested by suspending a fluorocarbon seal in oil solution at 300° F. for seven days and the change in physical properties (tensile strength percent elongation) was then measured.

| Type | %B | Wt. % in SF/CC Blend |
|---|---|---|
| HMDA.2PO | 0.00 | 4.0 |
| HMDA.2PO | 0.23 | 4.0 |
| HMDA.2PO (Ex. III) | 1.11 | 4.0 |
| HMDA.3PO | 0.00 | 4.0 |
| HMDA.3PO (Ex. I) | 0.23 | 4.0 |
| HMDA.3PO (Ex. V) | 0.99 | 4.5 |
| HMDA.4PO | 0.00 | 4.0 |

-continued

| | | |
|---|---|---|
| HMDA.4PO | 0.23 | 4.0 |
| HMDA | 0.00 | 4.0 |
| HMDA (Ex. II) | 0.20 | 4.0 |

| Type | % Elongation** | % Tensile Strength** |
|---|---|---|
| HMDA.2PO | −44 | −47 |
| HMDA.2PO | −35 | −39 |
| HMDA.2PO (Ex. III) | −21 | −15 |
| HMDA.3PO | −45 | −52 |
| HMDA.3PO (Ex. I) | −40 | −45 |
| HMDA.3PO (Ex. V) | −25 | −21 |
| HMDA.4PO | −56 | −57 |
| HMDA.4PO | −42 | −51 |
| HMDA | −24 | −25 |
| HMDA (Ex. II) | −27 | −28 |

**These values indicate the change in the indicated physical property as a result of aging the test specimen in the hot oil blend. A value of zero is ideal.

The above data clearly shows that boration of an unpropoxylated adduct has no substantial effect upon fluorocarbon seal test results whereas boration of hydroxypropylated dispersants reduces fluorocarbon seal attack as the concentration of boron in the dispersant increases.

EXAMPLE VIII

This Example illustrates the production of a borated reaction product of polybutenyl-succinic anhydride and hydroxyethylated hexamethylenediamine having approximately four hydroxyethyl groups per hexamethylenediamine moiety. Three hundred seventy grams hexamethylenediamine (3.19 moles) were heated to 180° C. in a one liter, 3-necked round bottom flask fitted with an overhead stirrer fritted glass gas dispersion tube, thermometer and heating mantle. While stirring vigorously, ethylene oxide was added through the gas dispersion tube for six and one-half hours until the product gained five hundred sixty-two grams, corresponding to reaction of 12.77 moles of ethylene oxide (4:1 ratio of ethylene oxide to hexamethylenediamine).

Thirty-five grams of the hydroxyethylated hexamethylenediamine (.120 moles), four hundred fifty grams of a 50% active oil solution of polybutenyl-succinic anhydride ( 161 moles) having a molecular weight of 1400, and one hundred sixty-five grams SX-5 base oil were heated at 190° C. for two hours with a mild nitrogen purge in the manner described in Example I.

A portion of this product (three hundred eighty-nine grams) was cooled to 100° C. and treated with fifty milliliters of xylene and 5.9 grams of boric acid. The mixture was then refluxed at 140° C. with azeotropic removal of water and finally heated to 180° C. with a nitrogen purge to remove the xylene. The product (including base oil) was filtered with celite and the final product contained 0.11% boron.

I claim:

1. A lube oil dispersant obtained by reacting a $C_8$–$C_{500}$ polybutene succinic acid or anhydride compound and a hydroxypropylated alkylene diamine, the diamine being the reaction product of propylene oxide and an alkylene diamine having the formula $NH_2$- $(CH_2)_X$-$NH_2$ where X is from 2 to 24, and having an average of at least about 2 N-substituted hydroxypropyl groups, said dispersant also containing boron at a level which improves the compatibility of the dispersant toward fluorocarbon engine seals.

2. The reaction product of claim 1 wherein the polybutenyl succinic compound is about $C_{50}$–$C_{200}$, the diamine is hexamethylene diamine, and the reaction product contains at least about 0.15wt. % boron.

3. The reaction product of claim 2 wherein the hydroxypropylated hexamethylene-diamine has an average of about 3N-substituted hydroxypropyl groups.

4. A lubricating oil composition comprising a lube oil and the boron-containing reaction product of claim 1.

5. A lubricating oil composition comprising a lube oil and the boron-containing reaction product of claim 2.

6. A method for producing a lube oil additive which comprises the steps of (I) reacting an unsubstituted alkyylene diamine having the formula $NH_2$-$(CH_2)_xNH_2$ where x is from 2 to 12, with at least 2.5 moles of propylene oxide per mole of alkylene diamine at 50° to 300° C.; (2) reacting the resulting N-hyydroxypropyl alkylene diamine with a $C_8$ to $C_{500}$ polybutenyl succinic acid or anhydride in a mole ratio of 0.5 to 20:1 at from 0° to 250° C.; and (3) borating the reaction product of step (2) at 50° to 250° with a boron compound in sufficient concentration to yield a product containing at least 0.15 wt. % boron.

7. The method of claim 6 wherein the alkylene diamine is hexamethylene diamine, the polybutenyl succinic compound is $C_{50}$–$C_{200}$ polybutenyl succinic anhydride, and the mole ratio of amine to succinic anhydride compound is about 3:1.

* * * * *

UNITED STATES PATENT OFFICE
CERTIFICATE OF CORRECTION

Patent No. 4,873,009 Dated October 10, 1989

Inventor(s) RONALD L. ANDERSON

It is certified that error appears in the above-identified patent and that said Letters Patent is hereby corrected as shown below:

| Column | Line | |
|---|---|---|
| 4 | 50 | "fifteen moles)" should read --fifteen grams of propylene oxide (7.15 moles)-- |
| 7 | 45 | "(161 moles)" should read --(.161 moles)-- |
| 8 | 40 | "50°. to 250°" should read --50° to 250°C-- |

Signed and Sealed this

Twenty-sixth Day of March, 1991

*Attest:*

HARRY F. MANBECK, JR.

*Attesting Officer*

*Commissioner of Patents and Trademarks*